United States Patent [19]

Bacon

[11] 3,972,527

[45] Aug. 3, 1976

[54] PASSENGER POWERED ROTATING AMUSEMENT RIDE

[75] Inventor: Karl W. Bacon, Mountain View, Calif.

[73] Assignee: Arrow Development Co., Inc., Mountain View, Calif.

[22] Filed: Oct. 16, 1975

[21] Appl. No.: 623,146

Related U.S. Application Data

[63] Continuation-in-part of Ser. No. 525,831, Nov. 21, 1974, abandoned.

[52] U.S. Cl. ..... 272/33 R; 272/38; 272/49

[51] Int. Cl.[2] ..... A63G 1/12

[58] Field of Search ..... 272/33 R, 38, 49, 55, 272/88, 89

[56] References Cited

UNITED STATES PATENTS

| | | | |
|---|---|---|---|
| 1,139,232 | 5/1915 | Schwarz | 272/33 R |
| 1,557,942 | 10/1925 | Matthews | 272/33 R X |
| 1,867,996 | 7/1932 | Baer | 272/49 X |
| 1,935,558 | 11/1933 | Haskell | 272/33 R |
| 2,403,593 | 7/1946 | Franklin | 272/33 R |

FOREIGN PATENTS OR APPLICATIONS

| | | | |
|---|---|---|---|
| 215,408 | 10/1909 | Germany | 272/49 |
| 409,620 | 5/1934 | United Kingdom | 272/38 |
| 492,135 | 9/1938 | United Kingdom | 272/38 |

*Primary Examiner*—Richard C. Pinkham
*Assistant Examiner*—Arnold W. Kramer
*Attorney, Agent, or Firm*—Limbach, Limbach & Sutton

[57] ABSTRACT

A passenger carrying cage pivotally mounted at one end of a movable support structure is rotatable completely about an elevated horizontal shaft. The passenger cage is stabilized by a positive mechanical connection between the cage and the shaft so as to maintain the same cage attitude relative to the ground in any of its rotatable positions about the shaft. The rotation is made possible by power supplied from within the passenger carrying cage by the passengers themselves reciprocating a lever whose reciprocation is transmitted by another positive mechanical connection between the cage and the horizontal shaft.

10 Claims, 5 Drawing Figures

FIG.3
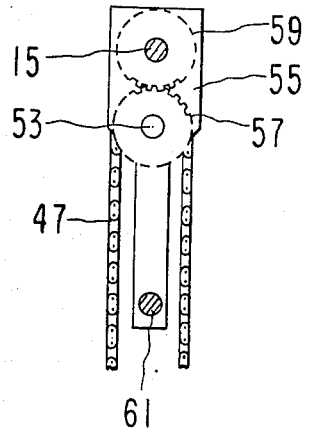
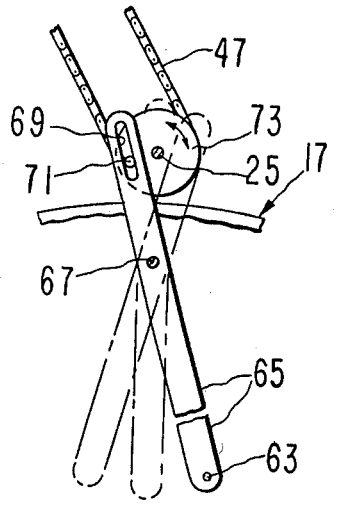
FIG.4
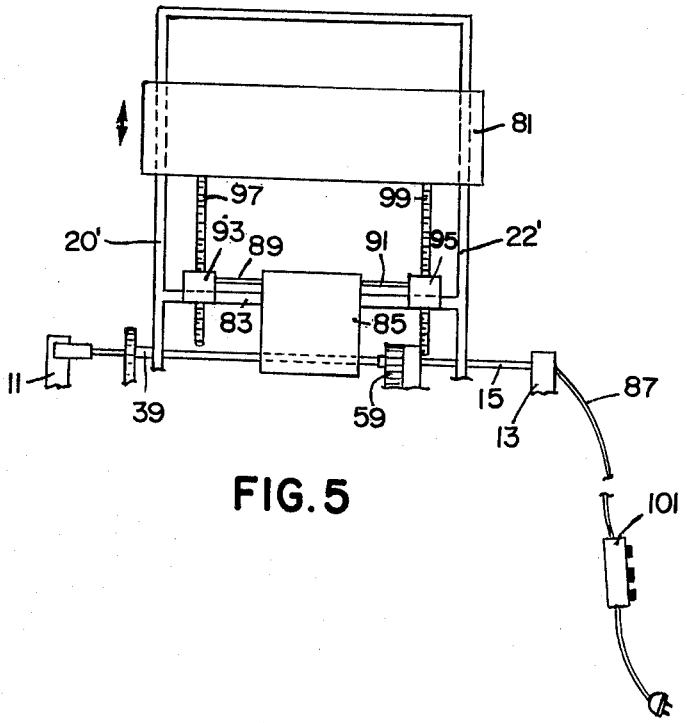
FIG.5

PASSENGER POWERED ROTATING AMUSEMENT RIDE

CROSS-REFERENCE TO RELATED APPLICATION

This is a continuation-in-part of copending U.S. patent application Ser. No. 525,831, filed Nov. 21, 1974, and now abandoned.

BACKGROUND OF THE INVENTION

This invention relates generally to passenger carrying amusement rides and more particularly to amusement rides of a type where a passenger is rotated completely about a fixed pivot shaft in space.

Various approaches to this type of ride exist in the prior art as illustrated by the following patents: U.S. Pat. Nos. 1,139,232 — Schwartz (1915); 1,557,942 — Mathews (1925); 1,867,996 — Baer (1932); 1,935,558 — Haskell (1933); 2,076,113 — Bartlett (1937); and 3,298,685 — Williams (1967); German Pat. No. 215,408 (1909); and British Pat. No. 492,135 (1938). It is a primary object of the present invention to provide an improved ride of this type that is simple to manufacture and economical but one which still provides a thrilling experience for the rider.

SUMMARY OF THE INVENTION

Briefly, the present invention provides a passenger carrying cage that is pivotally mounted at one end of a movable support structure, the other end of the support structure being pivotally mounted to a horizontal shaft suspended by a fixed support structure above ground a distance sufficient that the passenger cage can be rotated completely around the horizontal shaft. An additional positive mechanical connection between the passenger cage and the horizontal support shaft maintains the passenger carrying cage horizontal no matter where it is in its path of rotation about the horizontal shaft. The power to rotate the passenger carrying cage about the horizontal shaft comes from the passengers themselves by yet another operable connection between the passenger carrying cage and the horizontal shaft. A positionable counter weight permits compensation for a variable number and/or weight of the passengers of each ride.

Additional objects, advantages and features of the present invention will become apparent from the following description of a preferred embodiment thereof. This description should be taken in conjunction with the accompanying drawings.

BRIEF DESCRIPTION OF THE DRAWINGS

FIG. 3 is an enlarged side view of a portion of the ride of FIG. 1 taken at section 3—3 thereof;

FIG. 4 is an enlarged side view of a portion of the ride of FIG. 1 taken at section 4—4 thereof; and FIG. 5 illustrates a modification of the embodiment of FIGS. 1–4.

DESCRIPTION OF THE PREFERRED EMBODIMENT

Figure 1:
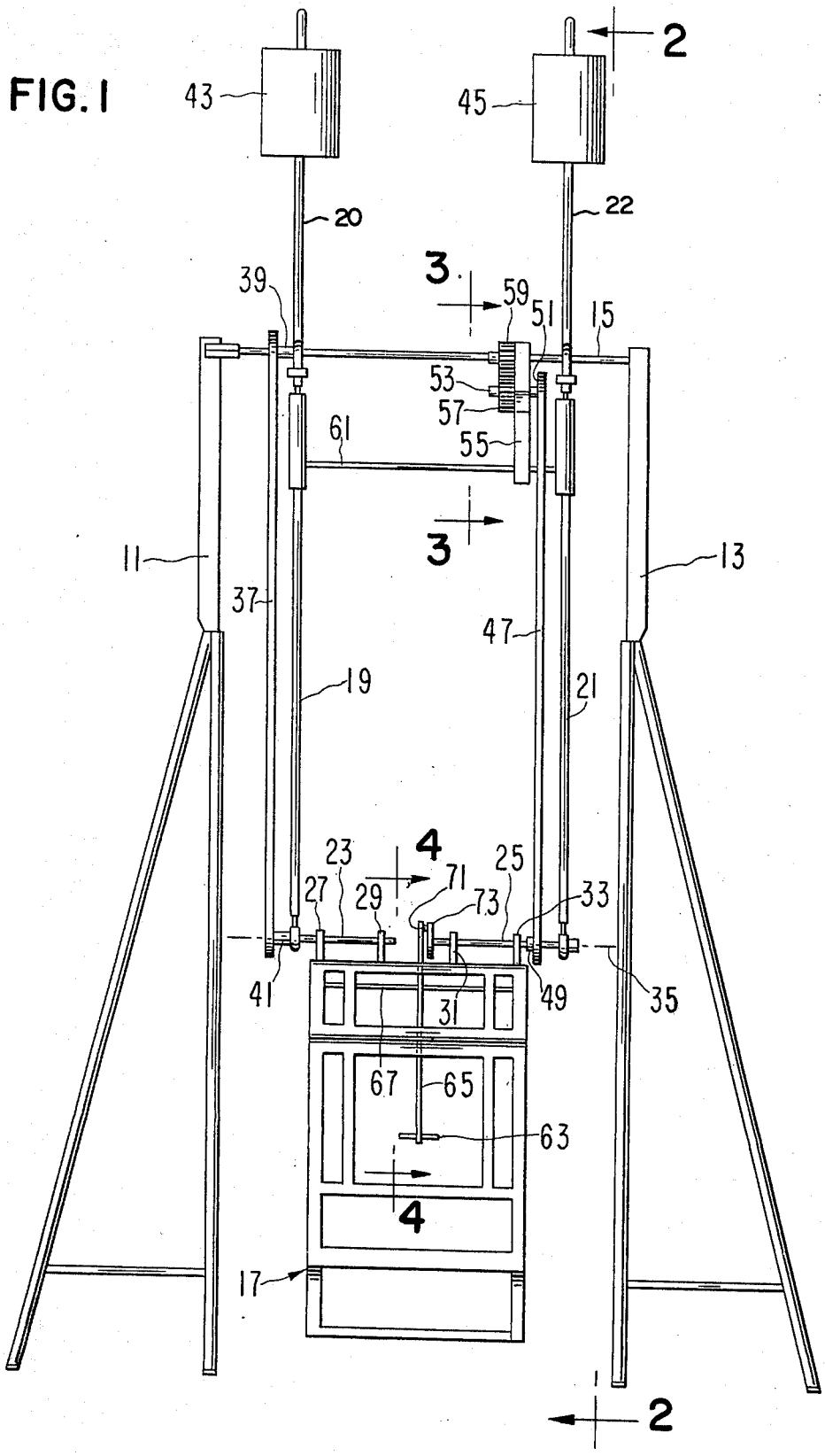
FIG. 1 shows a front elevation of a passenger carrying ride according to the present invention.

Referring primarily to FIG. 1, two spaced apart vertical supports 11 and 13 are connected at the top thereof by a horizontal shaft 15. The vertical structural members 11 and 13 are rigidly attached at their bottoms to the ground or other fixed structure and are not movable. A large area between the support members 11 and 13, and under the horizontal shaft 15, is maintained free of any obstructions so that a passenger carrying cage 17 and its associated supporting structure may be rotated in a full circle about the horizontal shaft 15.

The movable structure supporting the passenger carrying cage 17 includes two elongated support members 19 and 21. One end of each of the members 19 and 21 is supported by the shaft 15 at spaced apart positions by suitable journal connection therewith so that the members 19 and 21 are freely rotatable about the shaft 15 but still are capable of supporting a large amount of weight. The member 19 is similarly journaled onto a rod 23 at its opposite end. Thus, the member 19 is freely rotatable about the rod 23 while supporting a portion of the load of the passengers and passenger cage that is held in part by the rod 23. Similarly, the member 21 is journaled onto another rod 25. The rod 23 is held fixed against rotation with respect to the passenger cage 17 by attachment to support members 27 and 29 that are rigidly attached to the top of the passenger cage 17. The rod 25 is held by projections 31 and 33 of the passenger cage 17 but in a manner to be freely rotatable with respect thereto. The rods 23 and 25 are mounted so that their center axes line up along a common axis indicated at 35. The length of the support members 19 and 21 and their respective mountings at their opposite ends are designed so that this axis 35 remains substantially parallel with the support shaft 15 at all rotatable positions of the members 19 and 21 about the shaft 15. A circle traced out by the axis 35 as the members 19 and 21 are rotated around the shaft 15 has the shaft 15 as the circle's center.

Figure 2:
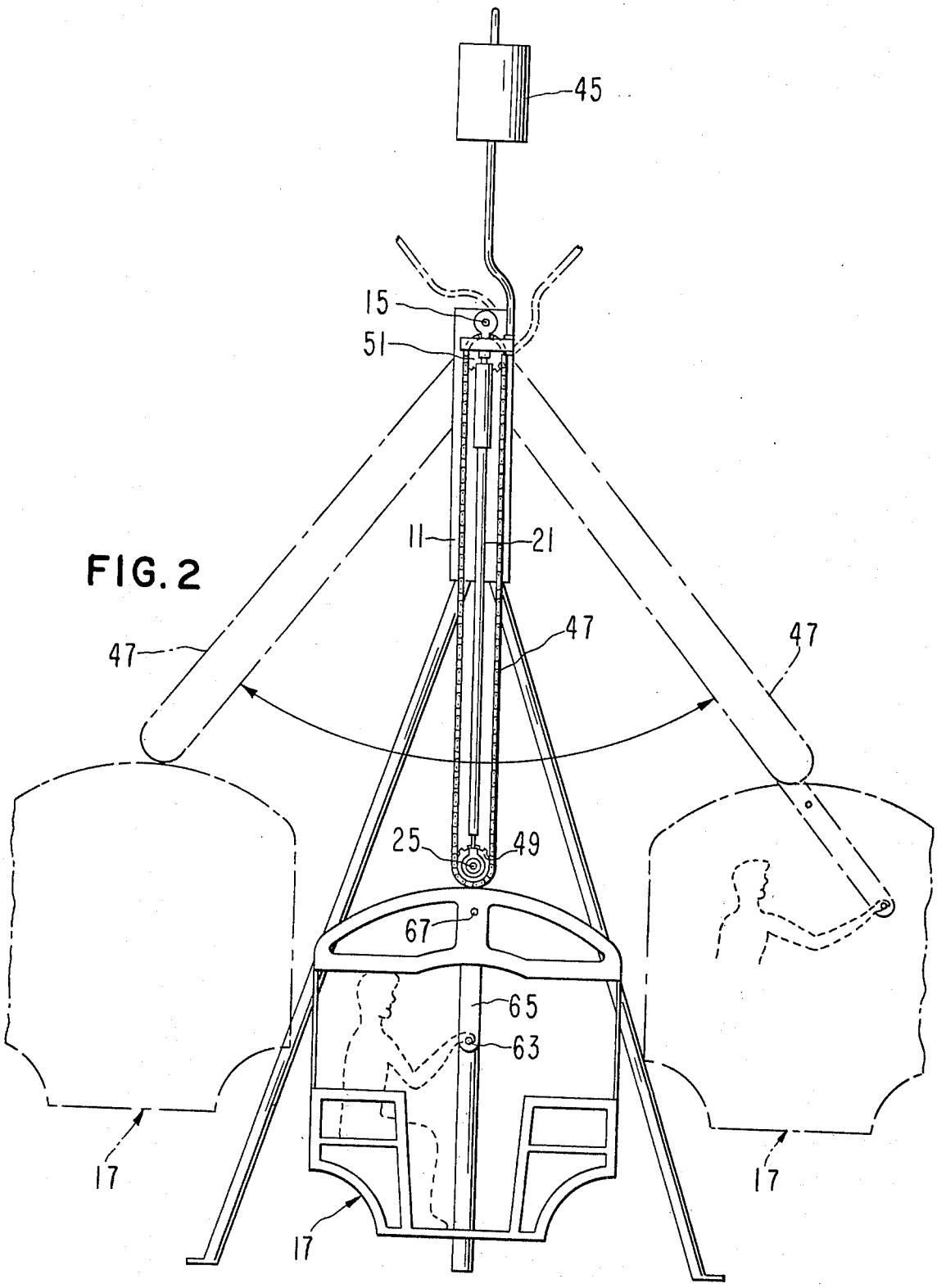
FIG. 2 shows a side elevation view of the ride of FIG. 1 taken at section 2—2 thereof.

Because of the free rotation between the support element 19 and the rod 23, and between the support element 21 and the rod 25, the passenger carrying cage 17 may rotate with respect to the members 19 and 21 as they themselves are rotated. This is illustrated in dashed outline in FIG. 2. An additional mechanism is provided in connection with the passenger carrying cage 17 and the shaft 15 in order to maintain the passenger cage 17 horizontal, as illustrated in FIG. 2, no matter what the rotatable position of the supporting members 19 and 21. This additional mechanism includes an endless stabilization chain 37 which engages the teeth of circular sprockets 39 and 41. The sprocket 39 is fixed to the support shaft 15 so that it does not rotate with respect to the shaft 15. The shaft 15 in turn is fixed to the support members 11 and 13. That is, the shaft 15 is held by the support members 11 and 13 in a manner to prevent rotation of the shaft 15. The circular sprocket 41 is also fixed to the rod 23 and since the rod 23 is fixed against movement with respect to the passenger cage 17, the sprocket 41 is so held against rotation with respect thereto. The center of the sprocket 39 is the axis of the support shaft 15 and the center of the sprocket 41 is the axis 35. The sprockets 39 and 41 are identical in diameter, number of teeth, etc. The result is that the elements 37, 39 and 41 positively maintain the passenger cage horizontal as the axis 35 is rotated in a circle about the support shaft 15. Rocking, swaying and oscillation of the passenger cage 17 that would result without the stabilization mechanisms 37, 39 and 41 is thus eliminated by it.

In order to modify the natural frequency of oscillation of the passenger carrying cage and its supporting structure while rotating about the horizontal support shaft 15, counter-balancing weights 43 and 45 are provided, respectively, on rigid extensions 20 and 22 of the support members 19 and 21, respectively. The weights 43 and 45 are thus on the opposite side of the rotation center at the shaft 15 from the passenger cage 17, and also act to reduce the effort required of the passengers to rotate themselves about the shaft 15.

In order that the passengers themselves within the cage 17 can propel the mechanism to swing about the support shaft 15, yet another connection between the passenger cage 17 and the horizontal support shaft 15 is provided. A second endless chain 47 extends between circular sprockets 49 and 51. The sprocket 49 is fixed on the rod 25 and thus is permitted to rotate with that rod with respect to the passenger cage 17. The sprocket 51 is fixed to a rod 53. The rod 53 is journaled in a supporting block of material 55. The rod 53 also carries a gear 57 fixed thereto on the opposite side of the block 55. The gear 57 engages another gear 59, the latter gear being fixed to the shaft 15. The supporting block 55 is held by the shaft 15 in a manner to be rotatable thereabout. An opposite end of the block 55 is securely fastened to a horizontal spacer 61. The spacer 61 is rigidly connected between the support members 19 and 21. It can thus be seen that this structure transfers rotation of the rod 25 to a rotation of the gear 57. A rotation of the gear 57 in turn causes the support structural elements identified by the reference numbers 19, 21, 55 and 61 to rotate about the horizontal support shaft 15. This results from the gear 57 moving around the outside surface of the gear 59. During such rotation, the support shaft 53 of the gear 57 and the sprocket 51 remains horizontal to and an equal distance from the support shaft 15.

This mechanism is caused to operate by passengers themselves that are sitting or standing within the passenger cage 17. Referring initially to FIG. 2, a passenger sitting within the cage 17, as shown in dashed outline, grips a handle 63 which is attached to a lever 65. Back-and-forth motion by the passenger through the handle 63 causes the lever 65 to rock back-and-forth about a pivot rod 67, as is best illustrated in FIG. 4. The pivot rod 67 is fixed to the passenger cage 17 and the lever 65 is permitted to rotate with respect thereto. The upper end of the lever 65 carries a slot 69 elongated in the direction of the length of the lever 65. Captured within the slot 69 is a pin 71, this pin being eccentrically mounted on a small circular wheel 73. The wheel 73 is fixed to the rod 25. Therefore, back-and-forth motion of the lever 65 by a passenger within the cage 17 is translated into rotary motion of the wheel 73. This rotary motion is thus used to give the entire mechanism motion, as described hereinabove.

The amount of effort required to operate the ride will depend upon the amount of weight carried by the passenger cage 17. This weight will depend upon the number of passengers therein and their individual weights. In order to maintain this required effort relatively uniform from ride to ride, a variable effective counterweight may be provided to be under control of the operator. Such a variable counter-weight mechanism is shown, in one embodiment, in FIG. 5. The embodiment of FIG. 5 shows a modification of the top structure of the swinging ride of FIG. 1.

Referring to FIG. 5, modified extensions 20' and 22' of the support members 19 and 21, respectively, carry a counter-weight 81 slidable therealong in a direction toward or away from the shaft 15. A rigid support shaft 83 connected between the elements 20' and 22' carries a housing 85 having an electric motor therein. The housing 85 is constructed with the rod 15 extending therethrough. The housing 85 is rotatable around the rod 15 when the swinging ride is operated. In order to energize the motor within the housing 85, an electrical circuit 87 extends within the rod 15 along the axis of rotation of the ride to an appropriate electrical commutator within the housing 85 which supplies energy to the motor therein at least when the passenger cage is in its lower most passenger loading and unloading position.

The motor within the housing 85 drives shafts 89 and 91 on opposite sides thereof which are operably connected to ball screw devices 93 and 95, respectively. The ball screw devices 93 and 95 cooperate, respectively, with threaded rods 97 and 99 which are fixedly attached to one side of the counter-weight 81. When the motor within the housing 85 is energized, its shafts 89 and 91 rotate in a selected direction. This rotation causes captive nuts within the elements 93 and 95 to rotate in the selected direction. These captive nuts are in threaded engagement with the shafts 97 and 99, thus causing the counter-weight 81 to move back-and-forth along the support elements 20' and 22'.

In operation, an amusement ride operator would energize the motor within the housing 85 through an appropriate electrical control 101 connected between a power source and the line 87. After the passengers have entered the passenger cage, the operator adjusts the position of the counter-weight 81 to an appropriate position.

Although specific examples of the present invention have been described, it will be understood that the various aspects of the present invention are entitled to protection within the full scope of the appended claims.

I claim:

1. A passenger powered amusement ride, comprising:

a fixed support frame having a horizontal shaft suspended in air with an unobstructed space therebeneath, a movable support structure pivotally mounted to said horizontal shaft in a manner to be pivotable in a complete circle thereabout, a passenger carrying cage, means pivotally mounting said cage at an axis to said movable support structure, means connecting said passenger cage with said horizontal shaft for maintaining said passenger cage horizontal at all positions of said supporting structure about said horizontal shaft, a rod mounted on said passenger cage coincident with said axis and rotatable with respect to said cage, means connecting said rod with said horizontal shaft for causing said movable support structure to rotate about the horizontal shaft in response to rotation of said rod with respect to said passenger cage, and a lever pivotably mounted to said cage in a manner permitting a passenger therein to move said lever back and forth about said lever pivot, said lever pivot being displaced on said cage a distance from said axis, means carried by said passenger cage and operably interconnecting to said rod with said lever for translating said back and forth motion of the lever to rotatable motion of said rod, whereby said movable support structure is caused to rotate in response to passenger motion and power applied to said lever.

2. The amusement ride according to claim 1 wherein said means connecting the passenger cage with the horizontal shaft includes a first gear fixed to said shaft, a second gear fixed to said passenger cage with its center coincident with said pivot axis, and means connected between said first and second gears for transmitting rotational motion therebetween, and wherein said means connected between said rod and said horizontal shaft for causing the support structure to rotate includes a third gear fixed to said rod, and a fourth gear fixed to said shaft, and means connected between said third and fourth gears for transmitting rotational motion therebetween.

3. The amusement ride according to claim 1 wherein said movable support structure extends a distance on a side of its said pivotally mounted means opposite said passenger cage, said amusement ride additionally comprises a counter-weight movably mounted on said support structure extension so that its distance from said pivotable mounting means may be adjusted, means carried by said movable support structure extension for adjusting the position of said counter-weight thereon relative to the pivotable mounting means, and means for controlling operation of said adjusting means, whereby the counter-weight may be adjusted by an amusement ride operator to compensate for varying weights in said passenger cage.

4. The amusement ride according to claim 3 wherein said counter-weight adjusting means includes a motor connected for moving said counter-weight, and wherein said controlling means includes a source of energy selectively connectable to said motor.

5. An amusement ride comprising:

a fixed support frame having a horizontal shaft suspended in air with an unobstructed space therebeneath, a movable support structure having two ends, one of said ends being pivotally mounted to said horizontal shaft in a manner to be pivotable in a complete circle thereabout, means pivotally mounted at the other end of said support structure at an axis for carrying passengers, whereby said passenger carrying means is rotatable all the way around said horizontal shaft, means connecting said passenger carrying means with said horizontal shaft for maintaining said passenger carrying means horizontal at all positions of said supporting structure about said horizontal shaft, means connecting said passenger carrying means with said horizontal shaft for causing said movable support structure to rotate with respect to said horizontal shaft in response to movement thereof by a passenger within said passenger support means, said support structure rotating means comprising:

a rod rotatably carried by said passenger carrying means, said rod being aligned with the pivot aixs of connection between the passenger carrying means and said support structure, a first gear fixedly attached to said suspended horizontal shaft, a second gear in meshed relationship with said first gear and rotatably attached to said support structure, means communicating the rotation of said rod to said second gear, and means within said passenger carrying means including means reciprocated by a passenger for rotating said rod, whereby passengers within the passenger carrying means can cause the support structure to rotate about said horizontal shaft and thereby to rotate themselves about said shaft as well.

6. The amusement ride according to claim 1 wherein said motion translating means includes an excentric pin attached to said rod for rotation therewith, and a cooperatively positioned slot along the length of said lever, said pin being captured by said slot for movement back-and-forth therein as said lever is moved back-and-forth by passenger motion, thereby to translate the back-and-forth motion of said lever into rotary motion of said rod.

7. The amusement ride according to claim 1 wherein only one passenger carrying cage is attached to said movable support structure, and wherein the amusement ride further comprises a counter-weight carried by the movable support structure in a position to counteract the rotational effect of the passenger cage upon said movable support structure.

8. The amusement ride according to claim 7 wherein said weight is movable relative to said movable support structure in a manner controlling its distance from the horizontal shaft, thereby permitting adjustment for different weight within said passenger cage.

9. The amusement ride according to claim 1 wherein said means connecting said rod with said horizontal shaft comprises:

a first gear fixedly attached to said suspended horizontal shaft, a second gear attached to said support structure for rotation with respect thereto and in meshed relationship with said first gear for all rotational positions of said movable support structure about said horizontal shaft, and means for communicating the rotation of said rod to said second gear.

10. The amusement ride according to claim 1 wherein said rod is located adjacent the top of said passenger carrying cage.

* * * * *